US006383064B1

(12) United States Patent
Eggert et al.

(10) Patent No.: US 6,383,064 B1
(45) Date of Patent: May 7, 2002

(54) FLEXIBLE ABRASIVE BODY

(75) Inventors: Martin Eggert, Hannover; Bettina Weiss, Celle, both of (DE)

(73) Assignee: Vereinigte Schmirgel- und Maschinen-Fabriken AG, Hannover (DE)

( * ) Notice: Subject to any disclaimer, the term of this patent is extended or adjusted under 35 U.S.C. 154(b) by 0 days.

(21) Appl. No.: 09/468,350

(22) Filed: Dec. 21, 1999

Related U.S. Application Data

(63) Continuation of application No. PCT/EP98/03827, filed on Jun. 23, 1998.

(30) Foreign Application Priority Data

Jun. 26, 1997 (DE) ..... 197 27 104

(51) Int. Cl.[7] ..... B24D 11/00
(52) U.S. Cl. ..... 451/526; 451/533
(58) Field of Search ..... 451/526, 527, 451/529, 528, 530, 532, 533, 536, 539

(56) References Cited

U.S. PATENT DOCUMENTS

| | | | |
|---|---|---|---|
| 4,925,457 | A | 5/1990 | deKok et al. |
| 5,049,165 | A | 9/1991 | Tselesin |
| 5,092,910 | A | 3/1992 | deKok et al. |
| 5,131,924 | A | 7/1992 | Wiand |
| 5,190,568 | A | 3/1993 | Tselesin |
| 5,203,881 | A | 4/1993 | Wiand |
| 5,389,119 | A | 2/1995 | Ferronato et al. |

FOREIGN PATENT DOCUMENTS

| | | |
|---|---|---|
| DE | 1 059 794 | 6/1959 |
| DE | 39 15 810 | 12/1989 |
| DE | 44 02 032 | 9/1995 |
| EP | 0 013 486 | 7/1980 |
| EP | 0 263 785 | 4/1988 |
| EP | 0 276 946 | 8/1988 |
| EP | 0 280 657 | 8/1988 |
| EP | 0 439 956 | 8/1991 |
| EP | 0 623 424 | 11/1994 |
| EP | 0 732 175 | 9/1996 |

*Primary Examiner*—Derris H. Banks
(74) *Attorney, Agent, or Firm*—Shlesinger, Arkwright & Garvey LLP

(57) ABSTRACT

The invention relates to a flexible abrasive body having a pliable support which exhibits one layer made from a pliable substrate on one side of which there is a full-coverage first metal coating and on this a second metal coating in which the abrasive material is at least partly embedded. In order to obtain an abrasive body of this kind with high thermal conductance, excellent flexibility, high dimensional stability and compactness, the support 9 consisting of substrate 2 and first metal coating 10 exhibits a constant thickness and the first metal coating 10 exhibits a flat, smooth surface and minimized coating thickness. The second metal coating 14 and also the first metal coating 10 are preferably provided with breaking points 18.

36 Claims, 2 Drawing Sheets

FLEXIBLE ABRASIVE BODY

CROSS REFERENCE TO RELATED APPLICATIONS

This application is a continuation of International Application No. PCT/EP98/03827, filed Jun. 23, 1998, which claims the priority of German Application No. 197 27 104.9, filed Jun. 26, 1997, and each of which is incorporated herein by reference.

FIELD OF THE INVENTION

The invention relates to a flexible abrasive body including a flexible abrasive medium having a pliable backing which exhibits one layer made from a pliable substrate on one side of which there is a full-coverage first metal coating in which the abrasive material is at least partly embedded.

BACKGROUND OF THE INVENTION

Flexible abrasive bodies include, for example, abrasives on underlays, like endless abrasive belts or abrasive sheets fitted to a pliable support. Crucial to the durability of such flexible abrasive bodies is that their pliable support resists the tensile, compressive and shear forces without impairment during the grinding process and that when in use the vital abrasive grain does not become detached too quickly from the composite material. In addition, the thermal stability of the flexible abrasive body with respect to fixing of the grain and load-carrying capacity of the support must be sufficient to withstand the high temperatures that occur during grinding especially in dry-grinding operations. The super cutting materials diamond and CBN (cubic boron nitride), distinguished by their high thermal conductance and extremely high hardness, require the grain embedment to exhibit a particularly high heat resistance. Owing to the good cutting ability of those abrasive grains, even when used to grind the very hardest of materials, it is particularly necessary that the heat generated at the grain by the grinding process be conducted to the grain bonding agent layer and into the pliable support in order to avoid excessive, damaging temperatures in the workpiece and severe heat-induced grain damage. To accomplish this it is known to electrostatically embed the abrasive grain in thermally stable, durable metal, primarily nickel; cf. DE 1 059 794, EP 276 946, EP 0 263 785, EP 0 280 653, EP 0 013 486, DE 39 15 810, which are described in more detail in the following.

The electrostatic abrasive coating has only one layer of abrasive. The layer of metal or nickel building up from the support interlocks with the grains which are being progressively spread in parallel fashion, whereby tee depth of embedment of the required cutting grain can be controlled exactly via the duration of the electrodeposition process. Owing to the single-coat nature of the abrasive layer, electrostatically bonded abrasive grain cannot be dressed; at best it is possible to compensate for differences in the height of the grain peaks by way of spot-grinding. This inability to rework electrostatically bonded abrasive bodies leads to a typical feature, namely that the compactness of the abrasive layer is at best only as good as the compactness permitted by the underlying support. For the relevant grain sizes (e.g. 20–600 $\mu$m with corresponding electrostatic embedment depths, e.g. 50–80%), a full-coverage, electrostatic metal bonding agent layer already exhibits a thickness which gives the planar structure the physical character of sheet metal. The thinner such layers, the higher is their flexibility or their fatigue strength under bending stress reversal because the relative difference between compressing and stretching the two sides of the planar structure decreases and the fatigue rupture under alternating loads is delayed. However such thin metal bonding agent layers just a few microns thick only have the ability to adequately anchor grain sizes of this order of magnitude. The strength and flexibility of electrostatic coatings may vary greatly, from stiff to brittle, almost to the suppleness of stress-free annealed rolled sheets, depending on bath composition, temperature, current densities and rate of deposition. Typically though, metal layers as thin as foil always exhibit a high sensitivity to impacts and buckling loads as well as low resistance to tear-propagation loads, which can be attributed to the low elastic deformability of the metal. Such irreversible, plastic deformations in a full-coverage, electrostatic grain bonding agent layer rule out its use as a highly durable, flexible abrasive body.

From DE 1 059 794 it is known to form a pliable support in the form of a metal layer on a flexible, endless steel belt which circulates in an electroplating solution and is wired as a cathode; spread over The surface of said belt is an abrasive grain bonded by means of an electrodeposited metal layer. This method creates a serviceable abrasive belt in the form of a metal foil with partly embedded abrasive grain when this abrasive coating is removed from the steel belt. The level of strength and the aforementioned problem of thin metal foils restrict the use of such abrasive belts to the very lightest of grinding operations or, owing to the limited flexibility, only the very thinnest electrostatic grain bonding agent layers and the very finest abrasive grits can be processed in this way to form flexible abrasive bodies. This abrasive coating can be laminated onto an abrasive support as a metallic coating. Although laminating the full-coverage electrostatic abrasive coating reduces the buckling susceptibility and raises the tearing strength, laminated flexible abrasive belts in continuous use generally suffer again and again from the problem that the extension ratios and the extension behaviour of the bonded layers differ. For instance, the use of laminated belts on grinding machines in which reversal and straight-running take place in dynamic alternation, the layer facing outwards is constantly subjected to tension and loading whereas at the same time the inner layer is constantly subjected to compression and relief. These differing longitudinal ratios must be compensated for elastically by the laminating adhesive. Furthermore, the extension behaviour of the different materials used for inner and outer layers differs considerably, like in the case of the electrostatic metal grain layer laminated onto an abrasive support discussed here. Durable laminated flexible abrasive bodies are only obtainable when the reversing radii are as large as possible and the laminated product is not too thick, because otherwise inner and outer belt lengths differ too greatly and adhesives that exhibit a mediating extension ability need to be employed. As a rule, the adhesive represents the weakest link in the planar composite system, meaning that just localized damage to the electrostatic abrasive coating leads to peeling and delamination of the whole coherent abrasive coating. To solve the problem of the lack of flexibility and the sensitivity of full-coverage, thin metal layers or metallic grain bonding agent layers in flexible abrasive media, various proposals have been made whose common feature is to refrain from using a full-coverage electrostatic abrasive coating on the surface of the flexible abrasive medium and instead to form the abrasive coating only at discrete, separate positions, i.e. isolated islands of abrasive coating arranged in regular patterns on a flexible substrate, e.g. cloth, whereby these isolated abrasive coatings are positioned on the surface offset with respect to each other in such a way that, in the direction of use, they overlap or abut. The interruption of the electrostatic coating, which becomes more and more rigid as the grain size and thickness of the layer increases, leads to the desired flexibility being essentially dependent on the underlying substrate because this has the chance to bend between the regularly arranged, discrete zones of abrasive coating.

For instance, a flexible abrasive medium is known from EP 0 280 657 in which a thin metal foil, copper in particular, is laminated onto a flexible, electrically non-conductive substrate so that a backing in the form of a planar composite material is obtained, one side of which is electrically conductive over its entire surface and the other side is electrically isolated. First, an electrically non-conductive mask with discrete openings is placed on the electrically conductive side and then metal, preferably nickel, is electrodeposited onto this together with the abrasive grain. During the electrodeposition process, the formation of the abrasive layer is restricted to the discrete openings in the mask so that islands of metal (nickel) abrasive coating and embedded grain are formed and not a complete covering. Thereafter, the mask separating the discrete abrasive zones is removed and the underlying metal foil still present etched away. Finally, the intermediate spaces are filled with resin and, if necessary, with silicon carbide powder. Instead of using a laminated metal foil, a metal layer can be attached directly to the substrate by means of a metallization process (electrochemical deposition without external currents, vapour-deposition or sputtering) and then processed further, as described, to form a flexible abrasive medium. The disadvantage of this is that in contrast to a smooch, laminated metal foil, the possible unevenness of the underlying substrate is not compensated for by the metallization process. This is not significant in the case of a flat, smooth substrate, e.g. foil or similar, but is significant for a substrate such as cloth, characterized by the loops of thread and undulations in the weave. An island-like coating of constant height cannot be built up on such an undulating, metal-coated cloth substrate, meaning that the clear projection of the embedded grain above the flexible abrasive body is not consistent either. The most severe disadvantage of this arrangement is that the island-type coating, which represents a heap of substrate, laminate adhesive if necessary, metal layer and metal bonding agent with grain, causes an overturning moment during grinding operations due to shear on the islands, and this can lead to them being easily torn away from the support. Filling the spaces between the islands with resin or resin and silicon carbide tiller is an attempt to reinforce this weak spot. The etched-off formally continuous metal or copper layer is interrupted to improve the flexibility, meaning that the thermally isolated island-like abrasive coating only permits a poor, interrupted transfer of heat into the flexible support.

A flexible abrasive body is known from EP 0 2163 785 in which a cloth substrate is used which is made electrically conductive by metal vapour-deposition or by interweaving metallic thread, or is formed by a metallized resin lattice. A mask containing discrete openings and made from polymer, electrically isolating resin is applied to this cloth under the action of heat and pressure. Metal, particularly nickel, is electrodeposited in the discrete openings in the presence of abrasive grain, thereby forming discrete abrasive coatings of deposited metal (nickel) and embedded grain. However the deposited metal adheres directly to the metallized cloth so the risk of the islands of abrasive grain becoming detached by shear forces during the grinding process is diminished. In this case the metallized fibres form thermal bridges between the individual abrasive coatings, although the conductance is low owing to the small cross-section of the fibres. The disadvantage of this version is that the undulations in the cloth prevent a consistent height being achieved for the island-type abrasive coatings. From this publication it is also known to mask an electrically conductive or non-conductive substrate in the form of a cloth in the aforementioned manner so that, again, openings are created for the electrostatic fixing of the grain. This masked cloth is fastened to a electrically conductive drum such that it cannot slip. The smooth drum wired as a cathode has the effect of causing the metal or nickel deposition to take place from its surface through the discrete openings of the cloth and the grain is attached only after the metal or nickel layer has interpenetrated the cloth. Upon completion of the electrostatic coating the flexible abrasive body is removed from the drum and can be laminated onto a stronger support.

This method can also be carried out continuously according to EP 0 276 946 when, instead of the rotating drum, an endless steel belt temporarily placed in non-slip, contact with the masked cloth, is passed through the electrolytic bath. The steel belt used as conveyor belt and cathode within the bath is separated from the flexible abrasive body outside the bath upon completion of the electrodeposition process and as a circulating belt picks up new cloth again at the entrance to the bath.

Advantageous with these flexible abrasive bodies according to EP 0 276 946 and the second version of EP 0 263 785 is that the metal-based island-like abrasive coating interlocks with the cloth from top to bottom and hence reduces the risk of the island-like abrasive coating being torn off by the overturning moment brought about by the grinding process. However like with all other arrangements of island-type, discrete abrasive coatings, the weak spot here is again the zones between the islands, the zones devoid of grain and metal or nickel. Here too the island-like abrasive coatings do not form thermal bridges with each other so the heat generated by the grinding process builds up in the island-like abrasive coatings. Another disadvantage is that only extremely thin, net-like, open, light cloths allow the metal (nickel) to interpenetrate evenly and interlock because the threads represent per se disruptions in the electrodeposition and thick electrostatic coatings generally cannot be produced without imperfections and also not consistently thick. The island-like, disc-like metal or nickel coatings attached by means of the smooth drum cathode or the smooth steel belt cathode lose their shape more and more towards the build-up side the thicker the layers become or at that moment when the cloth has been completely interlocked and enclosed. This means that after the cloth has been penetrated the metal- or nickel-coat discs present are not flat and not consistently thick and so cannot be used as a base for bonding abrasive grain electrostatically. The flexible abrasive body obtained in this way exhibits a low level of strength owing to the limited cloth thickness and cloth make-up and must be laminated onto a thicker support to provide strength. This increases further the thickness tolerance of the flexible abrasive body. In addition, laminating certainly improves the compressibility of the planar composite material in comparison to the individual components. This coating underneath the practically incompressible, disc-like metallic abrasive coatings places them on a more or less elastic base which rules out dimensionally accurate grinding.

A similar flexible abrasive body is known from E 0 013 486. An electrically non-conductive mask, with discrete openings for electrodeposition, is fitted to an electrically conductive drum. An electrically non-conductive cloth spanned over the drum wired as the cathode is only interpenetrated by electrodeposited metal (nickel or copper) at the discrete positions predetermined by the mask. After penetrating the cloth, grain is spread on and embedded in the growing layer of metal. Finally, the flexible abrasive body is removed from the drum and processed further. This flexible abrasive body is essentially only distinguished from the abrasive body according to EP 276 946 by the fact that the desired disc-shaped metal deposition is only aligned by the mask on the drum and no longer by the interpenetration of the cloth. Therefore, this abrasive body is only suitable for particularly fine, net-like cloths as flexible supports, e.g. when grinding lenses. In a modified version of this method, grain of equal height is achieved on the flexible abrasive body in an electrostatic but not single-coat grain layer. To do this, abrasive grain is first embedded electrostatically in the mask openings on the masked drum. When sufficient grain has been embedded, an electrically non-conductive cloth is laid on top and the metal deposition process started. After the cloth has been penetrated and the metal deposited to a certain thickness, the process is halted and the flexible abrasive body removed from the drum. The advantage of this arrangement is that a homogeneous rain height is achieved, but the grain is practically completely embedded and not very sharp for an electrostatically bonded grain, and hence only suitable for fine work. On the side of the flexible abrasive body away from the grain, the inconsistency of the disc-like abrasive coatings is again attributable to the build-up through the electrical disruption of the cloth. This means that adequate compactness of the flexible abrasive body cannot be accomplished.

A flexible abrasive body is known from DE 39 15 810 which has a pliable support of electrically conductive material (metal foil). Bonded or unbonded reinforcing threads are woven into the conductive material by means of overlapping seams. Further, the seams also connect a mat of non-conductive material on the other side of the metal foil with the metal foil. The upper side is isolated by a covering in discrete zones in such a way that between the reinforcing threads metal foil remains exposed onto which the metal is electrodeposited, forming protruding islands. Afterwards, a stabilizing coating of synthetic resin is applied to both sides of the support. The coating covers the mat, fills the spaces between the islands and also covers the islands. The support is subsequently ground away on the island side so that the metal islands are exposed. Metal and abrasive grain are then electrodeposited onto the islands. The disadvantage is the large amount of electrodeposited metal required because the reinforcing threads and connecting threads must be covered before the abrasive grain can be embedded electrostatically. The underlying metal foil does not remain rigid permanently. Alternatively, the first electrodeposition can cover the whole surface, whereby the reenforcing threads represent electrical disruptions; but the support then has a very stiff, rather inflexible sandwich construction.

OBJECTS AND SUMMARY OF THE INVENTION

The task of the present invention is to specify an abrasive body of the aforementioned type having high thermal conductance, excellent flexibility, high dimensional stability and compactness, as well as method for its production.

This task is solved by the invention comprising a flexible abrasive body, comprising:

a) a pliable backing including one layer made from a pliable substrate on one side of which there is a full-coverage first metal coating in which the abrasive material is at least partly embedded; and b) the backing including a substrate and first metal coating including a constant thickness, and the first metal coating including a constant thickness, and the first metal coating including a flat, smooth surface substantially free from disruptions, and a minimized coating thickness.

One or more of the following inventive features may likewise be included in embodiments according to the invention:

a second metal coating is provided with fractures;

the first metal coating is provided with fractures;

a second metal coating anchoring the abrasive material is arranged across the entire surface or at discrete points on the first metal coating;

the second metal coating is applied by way of electrodeposition on the first metal coating;

the substrate on the side opposite to the first metal coating has a coating of non-conductive material with a flat, smooth surface and minimized coating thickness;

the material of the coating is a resin;

reactive, cross-linkable precursors of thermosetting plastics, exhibiting a moldable, hardenable B-state, are used as hardenable resins;

the resin is phenolic resin;

the coating is provided with compression buckling points;

the substrate is textile structure;

the substrate is a cloth, braid, knitted fabric or non-woven fabric;

the substrate consists of thermally stable, organic, inorganic, metallized fibers or metallic fibers or a mixture thereof;

the first metal coating is made from copper;

the coatings are interlocked with the threads of the substrate;

the second metal coating is made from nickel;

the abrasive material is diamond or cubic boron nitride;

the thickness of the first metal coating and the thickness of the non-conductive material coating is 3–25 $\mu$m at each of the highest elevations of the substrate (cloth, braid, knitted fabric, non-woven fabric);

the breaking points and/or buckling points ran essentially transverse to the envisaged grinding direction;

full-coverage coating of one side of a pliable substrate with an excess of a first metal to form a first metal coating;

removal and levelling of the metal down to a predetermined thickness of the support formed by the substrate and the first metal coating;

coating of the first metal coating with a second metal to form a second metal coating with simultaneous embedment of the abrasive material;

the first metal coating is removed and levelled to such an extent that the highest elevations of the substrate still remained covered with a thin layer of metal the support on the side opposite to the first metal coating is provided with a coating made from a non-conductive material;

the support on the side opposite to the first metal coating is provided with a smooth, flat coating made from a non-conductive material;

the coating made from the non-conductive material is removed and levelled to such an extent that the highest elevations of the substrate still remain covered with a thin layer of material;

the thickness of the first metal coating and the coating of non-conductive material is in each case 3–25 μm;

the non-conductive material is a hardenable resin, in particular phenolic resin;

the first metal coating and/or the abrasive material is/are fractured;

fracturing of the metal coatings is carried out before, during and after applying the second metal coating;

the coating made from non-conductive material is provided with buckling lines;

both metal coatings are brittle;

foreign particles are embedded in the metal coatings;

the second metal coating is electrodeposited on the first metal coating;

the first metal coating is applied from the solid, liquid, gaseous or dissolved state of aggregation;

a bonding agent is used to improve the adhesion between first metal coating and substrate;

the levelling is carried out by rolling, plating, pressing, forging or shot-blasting; and the removal of the metal of the first metal coating and the material of the non-conductive coating is carried out by sand-blasting, milling, grinding, chemical or electro-etching, EDM or by cutting methods including one of laser, electron bear, and water jet.

The invention proposes providing a substrate, e.g. a textile structure such as cloth, knitted fabric, non-woven fabric, etc., with hard coating masses having smooth, flat surfaces and these to be on one or both sides such that on one side there is in electrically conductive material, preferably metal, e.g. copper, and in addition, if necessary, on the other an electrically non-conductive material, preferably a hardenable resin, e.g. phenolic resin. The substrate coated in this, way forms a support for abrasive grain and is dressed to a constant thickness such that the high spots of the support, at least on the metal-coated side, are still covered with a very thin layer of metal. The constrictions in the hard coating masses caused by the subsequent working (dressing) lend the support the necessary flexibility; on the other hand, a high compression resistance perpendicular to the support is preserved. Such ant arrangement is particularly advantageous when the substrate is a textile structure which exhibits undulations caused by the loop of thread, i.e. the thread crossings. The coatings here are fully interlocked with the threads. The highest thread elevations still remain, at least on the metal side, covered with a very thin layer of metal. i.e. approx. 3–25 μm, while the main amount of electrically conductive material (metal) and the electrically non-conductive material is localized between the thread crossings. The support with constant thickness and smooth metallic surface produced in this way forms an ideal, homogeneous support for a full-coverage, electrostatic coating with a metallic embedment material, preferably nickel, and with abrasive grain, thus rendering possible the production of a flexible abrasive body characterized by a uniform grain height and grain embedment.

Flexibility is further increased by fracturing the metal coatings, such as by providing a second metal coating with fractures; providing the first metal coating with fractures, and providing the coating with buckling points.

The invention shall be explained in more detail by means of the accompanying drawing which shows in schematic form the structure of the flexible abrasive body according to the invention by means of its step-by-step production.

DETAILED DESCRIPTION OF THE INVENTION

Figure 1:
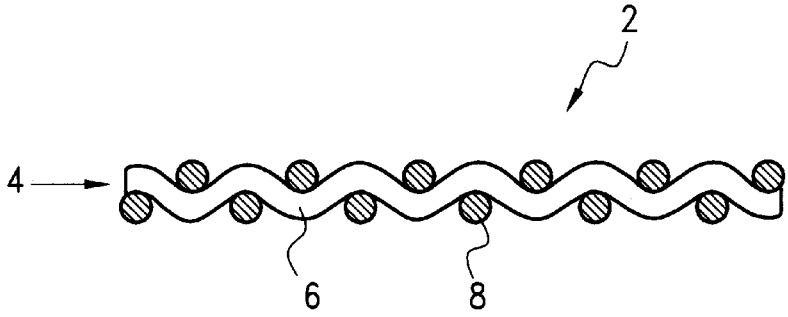
FIG. 1 a schematic section in the warp direction through a single-warp, single-weft substrate for a support to a flexible abrasive body, FIG. 2 the substrate according to FIG. 1 with a metal coating applied to one side (front face), FIG. 3 the substrate according to FIG. 2 with an additional coating on the side opposite to the metal coating (rear face) having ail electrically non-conductive material for forming a support to a flexible abrasive body.

Identical components in the figures of the drawing are given identical references FIG. 1 shows a substrate 2 for a support to a flexible abrasive body in the form of a singles-warp, single-weft cloth 4, where warp threads are designated 6 and weft threads 8. Other cloth structures exhibiting thread crossings, also hosiery, knitted fabrics, braids and non-woven fabrics, may be used for the substrate.

The thread crossings cause a certain undulation or unevenness in the surface of the substrate. To form a support 9 for the abrasive body the cloth 4 is provided on one side (hereinafter called front face) with an excess of metal coating 10 (FIG. 2, 3) and on the opposite side (hereinafter called rear face) with a coating 12 consisting of electrically non-conductive material, preferably a hardenable resin, e.g. phenolic resin. (FIG. 3, 4), whereby bonding agents and fillers may be used in addition if necessary.

The metal for the metal coating 10 is preferably copper and can be applied by way of suitable metallization processes. e.g. metal-spraying vapour-deposition, sputtering or electrochemical deposition without external currents.

Figure 2:
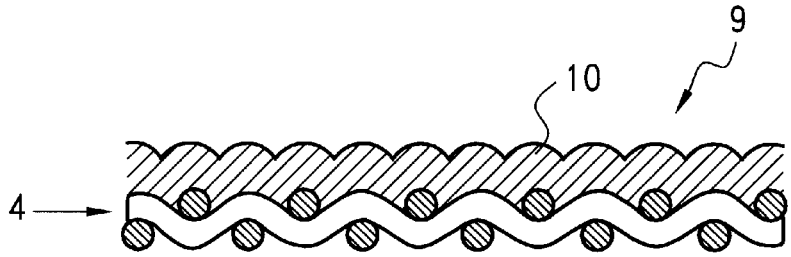
Figure 3:
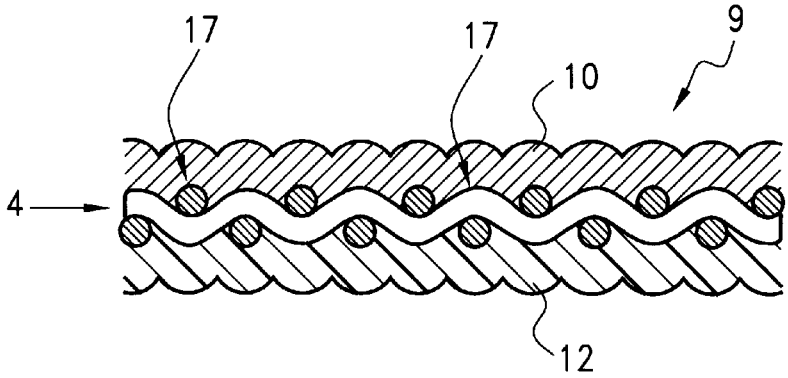

Owing to the raised threads at the crossings of warp and weft threads, the metal coating 10 takes on a corrugated surface, likewise the rear-face coating 12, see FIGS. 2 and 3.

Figure 4:
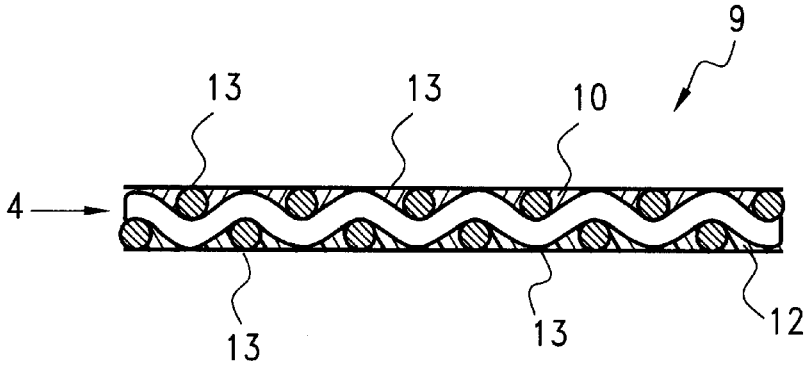
FIG. 4 the support according to FIG. 3 with dressed coatings.

To obtain a support having a constant thickness and a smooth surface, the coatings 10 and 12 are dressed, e.g. by grinding to size and, if necessary, by rolling, see FIG. 4. In doing so, at least the metal coating (copper) 10 on the front face of the support is removed to such an extent that the highest elevations of the cloth, braid, non-woven fabric, etc.—in the case of cloth really thin (in the order of magnitude of 5–15 μm) in the region of the crossings 17 of warp and weft threads—are covered by metal, while the main quantity of metal is positioned between the thread crossings. These regular constrictions 13 in the coatings 10 and 12 caused by the subsequent working lend the support 9 the necessary flexibility, and also a high compressive resistance perpendicular to the support because the metal or the non-conductive material (resin) is interlocked between the thread crossings 17 in alternating masses and the elastic resilience of the support under compressive loading is suppressed. The flexibility of the completely metal-coated cloth as provided by the constrictions is also influenced by the cloth structure, i.e. by the type of weave as well as density and location of thread crossings.

The rear-face coating 12 can be made to size with a smooth surface without subsequent working by applying the resin in liquid A-state, rolling it in the mouldable B-state and then letting it harden.

Figure 5:
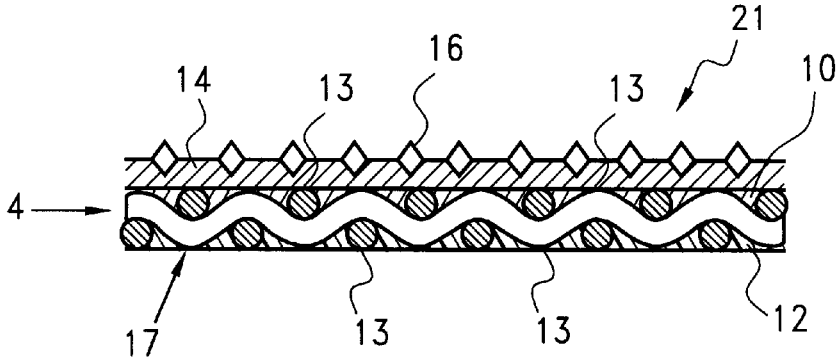
FIG. 5 the support according to FIG. 4 with a metal and abrasive grain coating electrodeposited over the whole surface of the metal coating on the front face in order to produce a flexible abrasive body, FIG. 6 the support according to FIG. 5 with a metal and abrasive grain coating electrodeposited in the form of islands on the metal coating on the front face in order to produce a modified flexible abrasive body, FIG. 7 the support or the abrasive body according to FIG. 5 in a fractured condition caused by bending (flexing).

The support 9 with constant thickness and smooth metallic surface produced in this way forms an ideal, homogeneous base for a full-coverage electrostatic coating with a metallic embedment material 14, preferably nickel, and abrasive grain 16, see FIG. 5, from which a flexible abrasive body 21 can be produced that is characterized by a uniform grain height and grain embedment. The dressed metal coating 10 wired as the cathode in this case.

Figure 7:
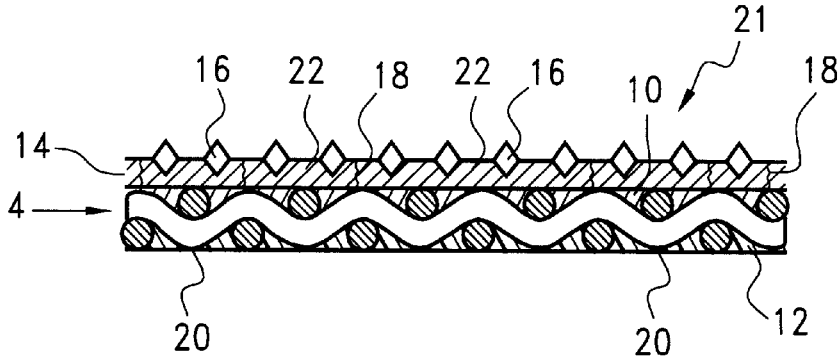

The unavoidable stiffening which occurs with a full-coverage electrostatic coating due to the metallic grain bonding agent layer 14 is eliminated according to the invention by "flexing" at least the rigid metallic abrasive coating 14, 16, i.e. by exceeding the maximum bending strength and thus introducing breaking points 18 at a regular spacing, whereby said constrictions 13 in the underlying metal coating 10 function as initiators, see FIG. 7. To increase the flexibility, the metal coating 10 is preferably also flexed or fractured, see FIG. 7. The flexing or fracturing can take place before, during or after the electrostatic coating. During flexing or fracturing, buckling points 20 ensue in the metal coating 12 on the rear face, see FIG. 7.

The electrostatic metal coating 14 is preferably made so brittle, and preferably the underlying metal coating 10 as well which is wired as the cathode during the electrostatic coating, that a real brittle breaking point ensues without buckling of the two metal coatings. The flexing or fracturing capacity of the two metal coatings can be further increased when these are subjected to a residual tensile stress. The brittleness and, if necessary, the superimposition of the residual tensile stress eases the formation of cracks when flexing or fracturing. This overcomes the risk that one or both metal coatings merely buckles without fracturing. This can happen if the metal coatings are produced or applied with porosity or microcracks or include defined impurities or defined quantities of foreign particles. The electrostatic metal (nickel) coating is first made easier to breaking point by the fact that it is present in a form continuously interrupted by abrasive grain. The brittleness, microcracks and particularly low extensibility exhibited by this metal coating are further influenced by the choice of an appropriate electrolyte (e.g. bright nickel plating and also by selecting suitable deposition parameters.

It has come to light that metal-spraying of copper, characterized by high application rates at relatively low substrate temperatures, is particularly suitable for metalizing the surface of the substrate (cloth). This thick-film metalizing technique allows excessive coating thicknesses to be achieved on the substrate so that in the subsequent processing to size copper can be removed from the copper layer following the undulations of the substrate to such an extent that the aforementioned foil-smooth copper surface and constrictions 13 at the thread crossings 17 of the underlying substrate (cloth) are obtained. Moreover it is a property of the various metal-spraying methods that metal-sprayed coatings are porous and contain oxides; in addition, these metal-sprayed coatings are subjected to residual tensile stresses, which also eases the desired brittle breaking point upon flexing or fracturing. Surprisingly, upon removing a bending load fill electrical contact is regained between the blocks of material 22 at the breaking points 18; otherwise a consistent, electrostatic coating of the cathodic support would not be possible.

Said flexible abrasive body according to FIG. 5 or 7 exhibits a series of further advantages. As there is an electrostatic abrasive grain coating across the whole surface, there are no weak spots in the surface of the abrasive body like those represented by the intermediate spaces of the interrupted island-like coating according to the state of the art. In contrast to the island-like coating the cutting forces are distributed in a planar fashion onto the stable, hard support and not as point loads onto a comparatively soft strong support, eventually leading to the island-type coatings possibly being sheared off. This full-coverage electrostatic coating does not lead to an overturning moment because the blocks of material 22 or the bending points encompass larger areas The massive interlocking anchorage of the underlying metal (copper) 10 in the substrate (cloth) enables heavy-duty grinding operations without loss of abrasive coating. Contrary to the island coating, the full-coverage coating leads to uninterrupted cutting and a more consistent surface pattern because the grinding pressure is distributed over the entire surface of the flexible abrasive body actually performing the grinding. At the same time, the force-grain ratio is reduced for a comparable coating density. The arrangement is particularly stable under compression and the even height of the electrostatic main embedment on the dressed support 9 permits very accurate grinding.

The flexible abrasive body according to FIGS. 5 and 7 is characterized by a very high thermal conductance because a full-cover-age, coherent metallic grain bonding agent layer is connected to a fill-coverage, coherent metallic underlay 10 which fills the depressions in the cloth and intermediate spaces solidly between thread crossings. The fact that large amounts of heat can be absorbed and carried away from the abrasive grain can be attributed to the high proportion by weight of this metal (⅔–⅚ of total weight). Furthermore, the content of solid metal has the effect that owing to the low thermal expansion of the metal the flexible abrasive body 29 undergoes only insignificant changes in thickness and length during grinding operations, a fact which is important for dimensionally accurate grinding.

Figure 6:
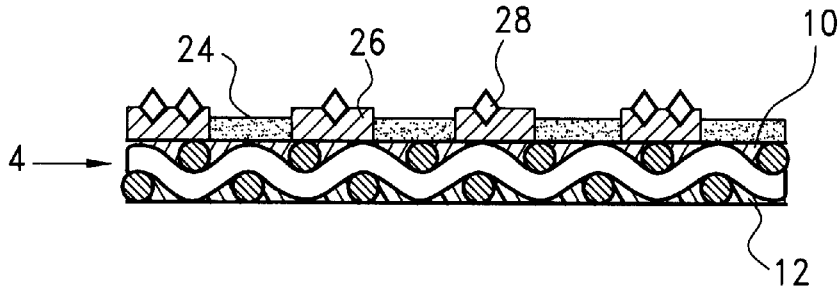

As an alternative to the aforementioned planar electrostatic coating, island-type abrasive coatings can also be produced of course when a mask 24, having discrete openings for electrostatic coating with a metallic embedment material 26, preferably nickel, and abrasive grain 28, is pressed onto the smooth, metallized support 9 before the electrostatic coating, see FIG. 6. In contrast to the known arrangements of island-type electrostatic abrasive coatings, however, this arrangement is not subjected to overturning moments during grinding because the coatings are supported on the solid, coherent base metal layer 10 and cannot be pressed down as points and sheared off.

With appropriate control of the coating parameters, metal-spraying, to apply the metal coating 10 is not exclusively confined to high-temperature substrates, Therefore, besides metallic and inorganic cloths, organic cloths, e.g. aramide, polyamides polyester or cotton and viscose or mixtures thereof, can also be considered when adequate cooling can be ensured and the amounts of metal to be applied and hence the quantities of heat to be conducted occur in stages. Proportions of metal fibres in the cloths have the effect of attaining greater adhesion for the, in the first instance, purely mechanical clamping of the metal-sprayed layer in the filaments of the threads; in addition, they improve the electrical conductivity.

The stiffness can be adjusted by impregnating the substrate and adding further rear-face coatings. In addition the impregnation has the task of improving the adhesion of the metal-sprayed layer to the fibres, the basically rough mental-sprayed layer representing good connecting points for this. A metal binding agent may be added, e.g. vulcanization systems, silane bonding agents, polyurethanes, epoxides. The rear-face coatings themselves are single- or multi-coat layers of hardenable resins, especially phenolic resins, as has already been mentioned, which, after application, may be calendered under high pressure in the mouldable B-state and finally fully hardened. Subsequent processing of the rear face is then unnecessary in terms of thickness tolerances because this is a coating method with optimum spreading characteristics.

What is claimed is:

1. A flexible abrasive body, comprising:

a) a pliable backing including one layer made from a pliable substrate on one side of which there is a full-coverage first metal coating in which the abrasive material is at least partly embedded; and b) the backing including a substrate and first metal coating including a constant thickness, and the first metal coating including a constant thickness, and the first metal coating including a flat, smooth surface substantially free from disruptions, and a minimized coating thickness.

2. Flexible abrasive body according to claim 1, wherein:

a) a second metal coating is provided with fractures.

3. Flexible abrasive body according to claim 2, wherein:

a) the second metal coating is applied by way of electrodeposition on the first metal coating.

4. Flexible abrasive body according to claim 2, wherein:

a) the second metal coating is made from nickel.

5. Flexible abrasive body according to claim 2, wherein:

a) the breaking points and/or buckling points run essentially transverse to the envisaged grinding direction.

6. Flexible abrasive body according to claim 1, wherein:

a) the first metal coating is provided with fractures.

7. Flexible abrasive body according to claim 1, wherein:

a) a second metal coating anchoring the abrasive material is arranged across the entire surface or at discrete points on the first metal coating.

8. Flexible abrasive body according to claim 1, wherein:

a) the substrate on the side opposite to the first metal coating has a coating of non-conductive material with a flat, smooth surface and minimized coating thickness.

9. Flexible abrasive body according to claim 8, wherein:

a) the material of the coating is a resin.

10. Flexible abrasive body according to claim 9, wherein:

a) reactive, cross-linkable precursors of thermosetting plastics, exhibiting a moldable, hardenable B-state, are used as hardenable resins.

11. Flexible abrasive body according to claim 10, wherein:

a) the resin is phenolic resin.

12. Flexible abrasive body according to claim 8, wherein:

a) the coating is provided with compression buckling points.

13. Flexible abrasive body according to claim 8, wherein:

a) the coatings are interlocked with the threads of the substrate.

14. Flexible abrasive body according to claim 8, wherein:

a) the thickness of the first metal coating and the thickness of the non-conductive material coating is 3–25 $\mu$m at each of the highest elevations of the substrate (cloth, braid, knitted fabric, non-woven fabric).

15. Flexible abrasive body according to claim 1, wherein:

a) the substrate is textile structure.

16. Flexible abrasive body according to claim 1, wherein:

a) the substrate is a cloth, braid, knitted fabric or non-woven fabric.

17. Flexible abrasive body according to claim 16, wherein:

a) the substrate consists of thermally stable, organic, inorganic, metallized fibers or metallic fibers or a mixture thereof.

18. Flexible abrasive body according to claim 1, wherein:

a) the first metal coating is made from copper.

19. Flexible abrasive body according to claim 1, wherein;

a) the abrasive material is diamond or cubic boron nitride.

20. Method for the production of a flexible abrasive body in which metal with embedded abrasive material is applied to a support according to claim 1, comprising the following procedure steps:

a) full-coverage coating of one side of a pliable substrate with an excess of a first metal to form a first metal coating;

b) removal and levelling of the metal down to a predetermined thickness of the support formed by the substrate and the first metal coating; and c) coating of the first metal coating with a second metal to form a second metal coating with simultaneous embedment of the abrasive material.

21. Method according to claim 20, wherein:

a) the first metal coating is removed and levelled to such an extent that the highest elevations of the substrate still remained covered with a thin layer of metal.

22. Method according to claim 21, wherein:

a) the thickness of the first metal coating and the coating of non-conductive material is in each case 3–25 $\mu$m.

23. Method according to claim 21, wherein:

a) the levelling is carried out by rolling, plating, pressing, forging or shot-blasting.

24. Method according to claim 20, wherein:

a) the support on the side opposite to the first metal coating is provided with a coating made from a non-conductive material.

25. Method according to claim 24, wherein:

a) the coating made from the non-conductive material is removed and levelled to such an extent that the highest elevations of the substrate still remain covered with a thin layer of material.

26. Method according to claim 25, wherein:

a) fracturing of the metal coatings is carried out before, during and after applying the second metal coating.

27. Method according to claim 24, wherein:

a) the non-conductive material is a hardenable resin, in particular phenolic resin.

28. Method according to claim 24, wherein:

a) the coating made from non-conductive material is provided with buckling lines.

29. Method according to claim 20, wherein:

a) the support on the side opposite to the first metal coating is provided with a smooth, flat coating made from a non-conductive material.

30. Method according to claim 20, wherein:

a) the first metal coating and/or the abrasive material is/are fractured.

31. Method according to claim 30, wherein:

a) both metal coatings are brittle.

32. Method according to claim 30, wherein:

a) foreign particles are embedded in the metal coatings.

33. Method according to claim 20, wherein:

a) the second metal coating is electrodeposited on the first metal coating.

34. Method according to claim 20, wherein:

a) the first metal coating is applied from the solid, liquid, gaseous or dissolved state of aggregation.

35. Method according to claim 34, wherein:

a) a bonding agent is used to improve the adhesion between first metal coating and substrate.

36. Method according to claim 20, wherein:

a) the removal of the metal of the first metal coating and the material of the non-conductive coating is carried out by sand-blasting, milling, grinding, chemical or electro-etching, EDM or by cutting methods including one of laser, electron beam, and water jet.

* * * * *